US009690219B2

(12) United States Patent
Koyama

(10) Patent No.: US 9,690,219 B2
(45) Date of Patent: Jun. 27, 2017

(54) MAGNETIC TONER

(71) Applicant: KYOCERA Document Solutions Inc., Osaka (JP)

(72) Inventor: Akinori Koyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/090,995

(22) Filed: Apr. 5, 2016

(65) Prior Publication Data

US 2016/0291491 A1 Oct. 6, 2016

(30) Foreign Application Priority Data

Apr. 6, 2015 (JP) ..... 2015-077793

(51) Int. Cl.

*G03G 9/08* (2006.01)
*G03G 9/083* (2006.01)
*G03G 9/087* (2006.01)

(52) U.S. Cl.

CPC ..... *G03G 9/0839* (2013.01); *G03G 9/08755* (2013.01)

(58) Field of Classification Search

CPC ... G03G 9/0839; G03G 9/132; G03G 9/08755
See application file for complete search history.

(56) References Cited

U.S. PATENT DOCUMENTS 6,447,968 B1 9/2002 Ohno
2005/0227160 A1* 10/2005 Shirai ..... G03G 9/083 430/109.4
2009/0239174 A1* 9/2009 Inaba ..... G03G 9/0926 430/112
2013/0196258 A1* 8/2013 Inaba ..... G03G 9/08755 430/105

FOREIGN PATENT DOCUMENTS

EP 0907112 A1 * 4/1999 ..... G03G 9/0825
JP 05061248 A * 3/1993
JP 05237369 A * 9/1993
JP H10-239897 A 9/1998

OTHER PUBLICATIONS

English language machine translation of JP 05-061248 (Mar. 1993).*
English language machine translation of JP 05-237369 (Sep. 1993).*

* cited by examiner

*Primary Examiner* — Christopher Rodee
(74) *Attorney, Agent, or Firm* — Studebaker & Brackett PC

(57) ABSTRACT

A magnetic toner includes toner particles. The toner particles contain a binder resin and a magnetic powder. The binder resin includes a crystalline polyester resin. The magnetic powder has a coating of a melamine resin. Preferably, the crystalline polyester resin has a solubility parameter ($SP_C$) of no less than 9.5, and the solubility parameter ($SP_C$) of the crystalline polyester resin and a solubility parameter ($SP_M$) of the melamine resin satisfy formula (1) shown below.

$$SP_C - SP_M > 1.0 \quad (1)$$

3 Claims, No Drawings

MAGNETIC TONER

INCORPORATION BY REFERENCE

The present application claims priority under 35 U.S.C. §119 to Japanese Patent Application No. 2015-077793, filed on Apr. 6, 2015. The contents of this application are incorporated herein by reference in their entirety.

BACKGROUND

The present disclosure relates to a magnetic toner.

A toner that has favorable low-temperature fixability even when heating thereof by a fixing roller is kept at a minimal level is preferable in terms of energy efficiency and device miniaturization. A toner having excellent low-temperature fixability is typically prepared using a crystalline polyester resin as a binder resin having a low melting point. Polyester resins are likely to be negatively charged. In particular, crystalline polyester resins tend to be negatively charged.

A magnetic material (for example, magnetic powder) is likely to be negatively charged. A magnetic toner that is used in a one-component development scheme has a longer life because of the absence of a carrier but tends to have a reduced charge. A conventional toner in the form of a one-component magnetic developer is therefore unable to achieve both satisfactory low-temperature fixability and satisfactory charge stability.

There have been proposed for example magnetic iron oxide particles surface-modified with a silane compound, a titanate compound, or an organosilicon compound. A known magnetic toner contains a surface-modified magnetic iron oxide.

SUMMARY

A magnetic toner according to the present disclosure includes toner particles. The toner particles contain a binder resin and a magnetic powder. The binder resin includes a crystalline polyester resin. The magnetic powder has a coating of a melamine resin.

DETAILED DESCRIPTION

The following describes an embodiment of the present disclosure in detail. The present disclosure is not in any way limited by the following embodiment. Appropriate changes may be made when practicing the present disclosure so long as such changes do not deviate from the intended scope of the present disclosure. Note that description is omitted where appropriate in order to avoid repetition but such omission does not limit the present disclosure. In the present description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

A magnetic toner (hereinafter, may be referred to simply as a toner) according to the present embodiment is a powder including a plurality of toner particles and can be used as a one-component developer. The toner according to the present embodiment can be used, for example, in an image forming apparatus. The term "toner mother particles" may be used to refer to toner particles prior to treatment with an external additive.

An electrophotographic image forming apparatus develops an electrostatic latent image using a developer that includes a toner. In a development process, charged toner is caused to adhere to an electrostatic latent image formed on a photosensitive member to form a toner image thereon. In a subsequent transfer process, the toner image on the photosensitive member is transferred onto a recording medium (for example, paper). The toner image is subsequently heated and pressurized to fix the toner image to the recording medium. As a result, an image is formed on the recording medium.

The toner according to the present embodiment includes toner particles. The toner particles include a binder resin and a magnetic powder satisfying the following features (1) and (2). Thus, the toner according to the present embodiment achieves excellent charge stability without resulting in reduced low-temperature fixability. Presumably, the reason therefor is as follows.

Feature (1): The binder resin includes a crystalline polyester resin.

Feature (2): The magnetic powder has a coating of a melamine resin.

The feature (1) is advantageous for improving low-temperature fixability of the toner. It is thought that the toner achieves excellent low-temperature fixability as a result of the binder resin including a crystalline polyester resin. The feature (2) is advantageous for improving charge stability of the toner. The melamine resin has nitrogen atoms and has a high tendency to be positively charged. The toner therefore has a high tendency to be positively charged. Having a coating of a melamine resin, the magnetic powder has a low tendency to be negatively charged. The toner is therefore thought to have excellent charge stability. Thus, the toner according to the present embodiment achieves excellent charge stability without resulting in reduced low-temperature fixability.

The toner particles may further contain optional components (for example, a releasing agent or a charge control agent) as necessary. Hereinafter, the binder resin, the magnetic powder, and the optional components will be described. Furthermore, a method for producing the toner will be described.

[1. Binder Resin]

The binder resin includes a crystalline polyester resin. The binder resin may further include a resin that is different from the crystalline polyester resin. The following describes the crystalline polyester resin and the resin that is different from the crystalline polyester resin.

<1-1. Crystalline Polyester Resin>

The crystalline polyester resin can for example be obtained through polycondensation or condensation copolymerization of an alcohol component and a carboxylic acid component. A di-, tri-, or higher-hydric alcohol can be used as the alcohol component. Specific examples of di-, tri-, or higher-hydric alcohol components that may be used include: diols such as ethylene glycol, diethylene glycol, triethylene glycol, 1,2-propanediol, 1,3-propanediol, 1,4-butanediol, neopentylglycol, 1,5-pentanediol, 1,6-hexanediol, 1,4-cyclohexanedimethanol, 1,2-propanediol, polyethylene glycol, and polytetramethylene glycol; bisphenols such as bisphenol A, hydrogenated bisphenol A, polyoxyethylene bisphenol A, and polyoxypropylene bisphenol; and tri- or higher-hydric alcohols such as sorbitol, 1,2,3,6-hexanetetraol, 1,4-sorbitan, pentaerythritol, dipentaerythritol, tripentaerythritol, 1,2, 4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Of the alcohol components listed above, aliphatic diols having a carbon number of no less than 2 and no greater than 8 are preferable, α,ω-alkanediols having a carbon number of no less than 2 and no greater than 8 are more preferable, and 1,4-butanediol and 1,6-hexanediol are still more preferable, in terms of promoting crystallization of the polyester resin.

In order to obtain a crystalline polyester resin, the alcohol component preferably includes no less than 80 mol % of one or more aliphatic diols having a carbon number of no less than 2 and no greater than 8, and more preferably no less than 90 mol %. Likewise, a component (single compound) having a largest content in the alcohol component preferably has a content of no less than 70 mol %, more preferably no less than 90 mol %, and most preferably 100 mol %.

A di-, tri-, or higher-basic carboxylic acid can be used as the carboxylic acid component. Specific examples of di-, tri-, or higher-basic carboxylic acid components include: di-basic carboxylic acids such as maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, alkyl succinic acids (more specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid); and tri- or higher-basic carboxylic acids such as 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid. An ester forming derivative of any of the di-, tri-, or higher-basic carboxylic acid components listed above such as a carboxylic acid halide, a carboxylic acid anhydride, or a carboxylic acid lower alkyl ester may be used. Herein, the term "lower alkyl" refers to an alkyl group that has a carbon number of no less than 1 and no greater than 6.

Of the carboxylic acid components listed above, aliphatic dicarboxylic acids having a carbon number of no less than 2 and no greater than 16 are preferable, and α,ω-alkanedicarboxylic acids having a carbon number of no less than 2 and no greater than 16 are more preferable, in terms of promoting crystallization of the polyester resin. The carboxylic acid components may further include mono-basic carboxylic acid. Examples of mono-basic carboxylic acids include stearic acid.

In order to obtain a crystalline polyester resin, the carboxylic acid component preferably includes no less than 70 mol % of one or more aliphatic dicarboxylic acids having a carbon number of no less than 2 and no greater than 16, and more preferably no less than 90 mol %. Likewise, a component (single compound) having a largest content in the carboxylic acid component preferably has a content of no less than 70 mol %, more preferably no less than 90 mol %, and most preferably 100 mol %.

The term "crystalline" in the "crystalline polyester resin" as used herein indicates that the resin exhibits a distinct endothermic peak rather than a step-wise endothermic change in differential scanning calorimetry (DSC). More specifically, the term "crystalline" means that the resin exhibits an endothermic peak with a half-width of no greater than 15° C. in DSC at a heating rate of 10° C./minute. A polyester resin that exhibits an endothermic peak with a half-width of greater than 15° C. and a polyester resin that exhibits no distinct endothermic peak are considered non-crystalline (amorphous).

The crystalline polyester resin preferably has a solubility parameter (SP value) of no less than 9.5, more preferably no less than 9.5 and no greater than 10.5, and still more preferably no less than 9.9 and no greater than 10.2. As a result of the SP value of the crystalline polyester resin being no less than 9.5, the toner has a low tendency to be negatively charged because of a large difference in SP value between the crystalline polyester resin and the melamine resin.

SP values as defined in the present disclosure are represented by the square root of molecular cohesive energy and can be calculated in accordance with a method described in R. F. Fedors, Polymer Engineering Science, 14, p 147 (1974). SP values are in units of $(MPa)^{1/2}$. SP values are values when the binder resin is at 25° C.

The SP value of the crystalline polyester resin can be adjusted by introducing a substituent into the crystalline polyester resin. More specifically, the SP value can for example be adjusted by adjusting the type or the number of substituents to introduce into the crystalline polyester resin.

In general, a smaller SP value indicates that the crystalline polyester resin is more hydrophobic, and a larger SP value indicates that the crystalline polyester resin is more hydrophilic. The SP value of the crystalline polyester resin can for example be reduced by introducing a hydrophobic substituent. Examples of hydrophobic substituents include an alkyl group, an alkenyl group, an alkynyl group, and an aryl group. The SP value of the crystalline polyester resin can for example be increased by introducing a hydrophilic substituent. Examples of hydrophilic substituents include a hydroxyl group, a carboxyl group, a cyano group, a nitro group, and an amino group.

Although no particular limitations are placed on the softening point (Tm) of the crystalline polyester resin, the crystalline polyester resin preferably has a softening point of no less than 50° C. and no greater than 100° C. In a situation in which a plurality of different types of crystalline polyester resins are used, the softening point (Tm) is that of a resin resulting from uniform melt-kneading of the crystalline polyester resins.

The softening point (Tm) of the crystalline polyester resin can for example be measured using a capillary rheometer (for example, "CFT-500D", product of Shimadzu Corporation). A measurement sample (crystalline polyester resin) is set in the capillary rheometer and an S-shaped curve (S-shaped curve of stroke (mm)/temperature (° C.)) is obtained by causing melt-flow of 1 $cm^3$ of the sample under conditions of a die diameter of 1 mm, a plunger load of 20 $kg/cm^2$, and a heating rate of 6° C./minute. The softening point (Tm) of the crystalline polyester resin is a temperature corresponding to a first shoulder part of the S-shaped curve.

The crystalline polyester resin preferably has a melting point ($MP^c$) of no less than 70° C. and no greater than 110° C. A toner including a crystalline polyester resin having a melting point ($Mp^c$) of no less than 70° C. and no greater than 110° C. is excellent in high-temperature preservability and low-temperature fixability and is capable of inhibiting occurrence of offset at high temperatures. More specifically, toner particles including a crystalline polyester resin having a melting point ($Mp^c$) that is too low (less than 70° C.) tend to adhere to a fixing roller when fixing is performed at high temperatures. Therefore, such toner particles have poor high-temperature preservability and result in a non-uniform image. Toner particles including a crystalline polyester resin having a melting point ($Mp^c$) that is too high (greater than 110° C.) tend not to melt during fixing of the toner to a recording medium. Therefore, such toner particles have poor low-temperature fixability and result in an image having a low gloss. The melting point and the softening point of the crystalline polyester resin are approximate. However, the melting point ($Mp^c$) of the crystalline polyester resin is preferably lower than the softening point of the later-described non-crystalline polyester resin.

The melting point ($Mp^c$) of the crystalline polyester resin can for example be measured using a differential scanning calorimeter ("DSC-6220", product of Seiko Instruments Inc.). More specifically an aluminum pan containing no less than 10 mg and no greater than 20 mg of the crystalline polyester resin is set in a measurement section of the differential scanning calorimeter. An empty aluminum pan is used as a reference. Heating is performed from 10° C. to 150° C. at a rate of 10° C./minute. A heat of fusion curve is obtained through the above measurement. The melting point ($Mp^c$) of the crystalline polyester resin is the temperature of a peak corresponding to a maximum of heat of fusion on the heat of fusion curve.

The crystalline polyester resin preferably has a weight average molecular weight of no less than 5,000 and no greater than 15,000. Having a weight average molecular weight of no less than 5,000 and no greater than 15,000, the crystalline polyester resin can be low-melting.

The crystalline polyester resin is preferably contained in an amount of no less than 20 parts by mass and no greater than 80 parts by mass relative to 100 parts by mass of the binder resin, and more preferably in an amount of no less than 30 parts by mass and no greater than 60 parts by mass. As a result of the crystalline polyester resin being contained in an amount of no less than 20 parts by mass and no greater than 80 parts by mass, the toner has improved low-temperature fixability and has a low tendency to be negatively charged.

<1-2. Resin Different from Crystalline Polyester Resin>

The resin that is different from the crystalline polyester resin is for example a thermoplastic resin. Examples of thermoplastic resins include styrene-based resins, acrylic acid-based resins, olefin-based resins (specific examples include polyethylene resins and polypropylene resins), vinyl resins (specific examples include vinyl chloride resins, polyvinyl alcohol, vinyl ether resins, and N-vinyl resins), non-crystalline polyester resins, polyamide resins, urethane resins, styrene-acrylic acid-based resins, and styrene-butadiene-based resins. Of the thermoplastic resins listed above, a non-crystalline polyester resin is preferable.

The non-crystalline polyester resin will be described. In order to prepare the non-crystalline polyester resin, it is necessary to inhibit crystallization of an obtained polyester resin. Although no particular limitations are placed on the method by which crystallization of the polyester resin is inhibited, the following methods (1) to (3) are provided as examples of common methods used for inhibiting crystallization.

Method (1): An alcohol component and a carboxylic acid component that promote crystallization of the polyester resin are not used or are only used in small amounts.

Method (2): At least two types of compounds are used as the alcohol component and the carboxylic acid component.

Method (3) An alcohol component such as a bisphenol A-alkylene oxide adduct or a carboxylic acid component such as alkyl-substituted succinic acid is used.

Of the methods for inhibiting crystallization listed above, the method (3) is preferable in terms that a non-crystalline polyester resin can be easily prepared through a small number of different types of monomers. In the method (3), increasing the amount of the alcohol component (for example, bisphenol A-alkylene oxide adduct) and the amount of the carboxylic acid component (for example, alkyl-substituted succinic acid) tends to further inhibit crystallization. However, the amounts of such monomers are preferably adjusted as appropriate in consideration of the crystallinity index and other physical properties of the polyester resin to be obtained. One non-crystalline polyester resin may be used independently, or two or more non-crystalline polyester resins may be used in combination.

[2. Magnetic Powder]

As already mentioned above, the toner particles include a magnetic powder. Examples of magnetic powders that may be used include iron such as ferrite or magnetite; ferromagnetic metals such as cobalt or nickel; alloys including either or both of iron and a ferromagnetic metal; compounds including either or both of iron and a ferromagnetic metal; ferromagnetic alloys subjected to ferromagnetization such as heat treatment; and chromium dioxide.

The magnetic powder has a coating of a melamine resin. Since the melamine resin contains nitrogen atoms, a toner including a melamine resin has a high tendency to be positively charged. Furthermore, the magnetic powder itself has a low tendency to be negatively charged as having a coating of a melamine resin. Toner particles including a magnetic powder having a coating of a melamine resin therefore has a high tendency to be positively charged.

The melamine resin is a polycondensate of melamine and formaldehyde. The melamine resin may be formed through condensation polymerization of melamine and formaldehyde or through condensation polymerization of a prepolymer (hereinafter, may be referred to as an initial polymer). The term "prepolymer" used herein refers to an intermediate product obtained by stopping polymerization of a monomer at a stage before the degree of polymerization reaches the degree of polymerization for a polymer. The prepolymer for forming the melamine resin is for example methylol melamine. The methylol melamine is a derivative obtained through methylolation of melamine with formaldehyde.

The melamine resin preferably has an SP value of no greater than 8.5, more preferably no less than 8.0 and no greater than 8.5, and still more preferably no less than 8.2 and no greater than 8.5. Preferably, an SP value ($SP_C$) of the crystalline polyester resin and an SP value ($SP_M$) of the melamine resin satisfy formula (1) shown below.

$$SP_C - SP_M > 1.0 \quad (1)$$

As a result of the formula (1) being satisfied, the toner is easily improved in charge stability. The melamine resin is less compatible with the crystalline polyester resin. Therefore, the melamine resin that is positively charged is less prone to charge decay due to the crystalline polyester resin.

As in the SP value of the crystalline polyester resin mentioned above, the SP value of the melamine resin can be adjusted by introducing a substituent into the melamine resin.

In a configuration in which the binder resin further includes a resin that is different from the crystalline polyester resin (i.e., an additional resin that is included in combination with the crystalline polyester resin (hereinafter, may be referred to simply as an additional resin)), the SP value ($SP_M$) of the melamine resin, the SP value ($SP_C$) of the crystalline polyester resin, and an SP value ($SP_T$) of the additional resin satisfy a relationship represented by formula (2) shown below in terms of easily maintaining positive chargeability of the toner.

$$SP_C > SP_T > SP_M \quad (2)$$

As a result of the formula (2) being satisfied, the crystalline polyester resin and the melamine resin tend to be less compatible with one another. Furthermore, the crystalline polyester resin and the additional resin tend to be readily compatible with one another, and the melamine resin and the additional resin tend to be readily compatible with one another. Consequently, the additional resin can be favorably interposed between the crystalline polyester resin and the melamine resin in each toner particle. Since the additional resin thus functions as a spacer between the crystalline polyester resin and the melamine resin, the melamine resin that is positively charged is less prone to charge decay due to the crystalline polyester resin. As a result, the toner can easily maintain its positive chargeability.

The magnetic powder having a coating of the melamine resin is preferably contained in an amount of no less than 30 parts by mass and no greater than 100 parts by mass relative to 100 parts by mass of the polyester resin. As a result of the melamine resin being contained in an amount of no less than 60 parts by mass and no greater than 90 parts by mass, the toner has improved low-temperature fixability and has a high tendency to be positively charged.

The coating of the melamine resin preferably has a layer thickness of no less than 0.1 μm and no greater than 10 μm.

The magnetic powder for example has a spherical shape or a faceted shape with edges. The faceted shape with edges is for example a hexahedral shape, which is a convex polyhedron with six rectangular faces, or an octahedral shape, which is a convex polyhedron with eight triangular faces. The shape of the magnetic powder can be confirmed on an image captured using a transmission electron microscope (TEM).

The magnetic powder is preferably contained in an amount of no less than 40% by mass relative to mass of the binder resin, and more preferably in an amount of no less than 40% by mass and no greater than 60% by mass.

The magnetic powder preferably has a particle size of no less than 0.1 μm and no greater than 1.0 μm, and more preferably no less than 0.1 μm and no greater than 0.5 μm. As a result of the magnetic powder having a particle size in the above-specified range, homogeneous dispersion of the magnetic powder throughout the binder resin can be easily achieved.

[3. Optical Components]

As already mentioned above, the toner particles include the binder and the magnetic powder, and may further contain optional components (for example, a releasing agent or a charge control agent) as necessary. The following describes the releasing agent and the charge control agent.

<3-1. Releasing Agent>

The toner particles may include a releasing agent as necessary. A releasing agent is usually used in order to improve fixability and offset resistance of the toner.

Preferably, the releasing agent is a wax. Examples of waxes that may be used include ester wax, polyethylene wax, polypropylene wax, fluororesin-based wax, Fischer-Tropsch wax, paraffin wax, and montan wax.

Of the releasing agents listed above, ester wax is more preferable. The ester wax is for example a synthetic ester wax or a natural ester wax (specific examples include carnauba wax and rice wax). A combination of two or more of the releasing agents listed above can be used.

Of the ester waxes, a synthetic ester wax is preferable because it is easy to adjust a melting point of the releasing agent to within a preferable range explained below through appropriate selection of raw materials of the synthetic ester wax.

No particular limitations are placed on the method by which the synthetic ester wax is prepared so long as the synthetic ester wax is prepared by a chemical synthetic method. The synthetic ester wax can for example be prepared according a known method (through a reaction of an alcohol and a carboxylic acid or a reaction of a carboxylic acid halide and an alcohol in the presence of an acid catalyst). The raw materials of the synthetic ester wax may for example be derived from natural products such as a long-chain fatty acid produced from a natural oil or fat, or may be commercially available synthetic products.

The releasing agent preferably has a melting point (Mpr) of no less than 50° C. and no greater than 100° C. The melting point of the releasing agent can for example be measured using a differential scanning calorimeter in accordance with the method for measuring the melting point ($Mp^c$) of the crystalline resin. The melting point of the releasing agent can be determined from the temperature of a peak indicating maximum heat absorption on a DSC curve plotted using the differential scanning calorimeter. As a result of the melting point of the releasing agent being in the above-specified range, the toner that includes toner particles including toner cores containing such a releasing agent tends to have excellent low-temperature fixability and inhibit occurrence of offset even when the toner is fixed at high temperatures.

The amount of the releasing agent is preferably no less than 1 part by mass and no greater than 30 parts by mass relative to 100 parts by mass of the binder resin, and more preferably no less than 5 parts by mass and no greater than 20 parts by mass.

<3-2. Charge Control Agent>

The toner particles may contain a positively chargeable charge control agent as necessary. The charge control agent is used in order to improve the charge level of the toner and a charge rise characteristic of the toner, thereby obtaining a toner having excellent properties in terms of durability and stability. The charge rise characteristic of the toner is an indicator as to whether the toner can be charged to a specific charge level in a short period of time.

The charge control agent can be selected as appropriate from known charge control agents. Specific examples of positively chargeable charge control agents that may be used include azine compounds (for example, pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-axadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, or quinoxaline), direct dyes made from an azine compound (azine fast red FC, azine fast red 12BK, azine violet BO, azine brown 3G, azine light brown GR, azine dark green BH/C, azine deep black EW, or azine deep black 3RL), nigrosine compounds (nigrosine, nigrosine salts, or nigrosine derivatives), acid dyes made from a nigrosine compound (nigrosine BK, nigrosine NB, or nigrosine Z), metal salts of naphthenic acids and metal salts of higher fatty acids, alkoxylated amines, alkylamides, and quaternary ammonium salts (benzyldecylhexylmethylammonium chloride or decyltrimethylammonium chloride). Of the positively chargeable charge control agents listed above, nigrosine compounds are particularly preferable in terms of readily improving the charge rise characteristic of the toner. One of the positively chargeable charge control agents listed above may be used independently, or two or more positively chargeable charge control agents may be used in combination.

A resin having a quaternary ammonium salt, a salt of carboxylic acid, or a carboxyl group as a functional group may be used as the positively chargeable charge control agent. More specific examples thereof include styrene-based resins having a quaternary ammonium salt, acrylic acid-based resins having a quaternary ammonium salt, styrene-acrylic acid-based resins having a quaternary ammonium salt, polyester resins having a quaternary ammonium salt, styrene-based resins having a salt of carboxylic acid, acrylic acid-based resins having a salt of carboxylic acid, styrene-acrylic acid-based resins having a salt of carboxylic acid, polyester resins having a salt of carboxylic acid, styrene-based resins having a carboxyl group, acrylic acid-based resins having a carboxyl group, styrene-acrylic acid-based resins having a carboxyl group, and polyester resins having a carboxyl group. These resins may be oligomers or polymers.

The amount of the positively chargeable charge control agent is preferably no less than 0.5 parts by mass and no greater than 20.0 parts by mass relative to 100 parts by mass of the toner overall, and more preferably no less than 1.0 part by mass and no greater than 15.0 parts by mass.

[4. Others]

The toner particles may each include a shell layer. The shell layer is disposed over each toner particle. The shell layer for example includes a thermosetting resin or a thermoplastic resin.

An external additive may be attached to the surface of the toner par tides as necessary.

The external additive is for example silica or a metal oxide. Examples of metal oxides that may be used include alumina, titanium oxide, magnesium oxide, zinc oxide, strontium titanate, and barium titanate.

The external additive preferably has a particle size of no less than 0.01 μm and no greater than 1.0 μm.

The amount of the external additive is preferably no less than 0.5 parts by mass and no greater than 10 parts by mass relative to 100 parts by mass of the toner particles.

[Toner Production Method]

The following describes a toner production method. No particular limitations are placed on the toner production method. The following describes a preferable production method of the toner according to the present embodiment. The toner production method for example includes a preparatory process and a toner particle preparation process.

<1. Preparatory Process>

In the preparatory process, as already mentioned above, a binder resin and a magnetic powder having a coating of a melamine resin are prepared. A crystalline polyester resin and a non-crystalline polyester resin are prepared as the binder resin.

The following describes a specific example of the preparation of the crystalline polyester resin. An alcohol and a carboxylic acid are mixed at a specified ratio to give a monomer mixture. Next, the monomer mixture is heated under stirring up to a specific temperature of no less than 210° C. and no greater than 250° C. under a nitrogen atmosphere. The specific temperature is maintained to cause a polymerization reaction of the monomers. As a result, the crystalline polyester resin is obtained.

The following describes a specific example of the preparation of the non-crystalline polyester resin. An alcohol and a carboxylic acid are mixed at a specified ratio to give a monomer mixture. Next, the monomer mixture is heated under stirring up to a specific temperature of no less than 180° C. and no greater than 220° C. under a nitrogen atmosphere. The specific temperature is maintained to cause a polymerization reaction of the monomers to give the non-crystalline polyester resin.

The following describes a specific example of the preparation of the magnetic powder having a coating of a melamine resin. The preparation of the magnetic powder having a coating of a melamine resin includes a magnetic powder preparation step and a coating step. The following explains an example of the magnetic powder preparation step in which magnetite particles are prepared. An alkali (for example, an alkali metal hydroxide) is added into an aqueous ferrous sulfate solution to give a liquid mixture. The liquid mixture thus obtained is heated to a specific temperature. The pH of the liquid mixture is adjusted to mildly alkaline (for example, a pH of no less than 8 and no greater than 11). The specific temperature of the liquid mixture is preferably no less than 70° C. and no greater than 95° C. The liquid mixture is stirred with aeration while being maintained at the specific temperature. As a result, an oxidation reaction occurs to give a suspension. Preferably, the time of the aeration is for example no less than 50 minutes and no greater than 300 minutes. The volume of air for the aeration of the liquid mixture is preferably no less than 60 L and no greater than 100 L per minute.

An acid (for example, sulfuric acid) is added to the suspension to adjust the suspension to approximately pH 7. Furthermore, the suspension is subjected to aeration while being maintained at the specific temperature. As a result, a magnetite particle dispersion is obtained. Preferably, the time of the aeration is for example no less than 5 minutes and no greater than 30 minutes. The volume of air for the aeration of the suspension is preferably no less than 60 L and no greater than 100 L per minute. The thus obtained magnetite particle dispersion is filtered to obtain a filter cake. The filter cake is washed with an aqueous medium (for example, water), dried, and pulverized. As a result, magnetite particles having a desired size are obtained.

The following describes the coating step. In the coating step, the magnetic powder is coated with a melamine resin. More specifically, particles of the magnetic powder obtained as described above are dispersed in an aqueous medium (for example, water) to give a suspension. The suspension is adjusted to mildly acidic. The pH of the suspension is preferably no less than 3 and no greater than 6. Thereafter, a coupling agent is added to the mildly acidic suspension to treat surfaces of the particles of the magnetic powder. The coupling agent is for example a silane coupling agent. The percentage of the coupling agent to be added is preferably several percent by mass (for example, no less than 1% by mass and no greater than 10% by mass) relative to the magnetic powder in the suspension. The surface-treated magnetic powder is collected through washing and drying.

Next, a mildly acidic aqueous medium (for example, a pH of no less than 3 and no greater than 6) is heated, and a material for forming a melamine resin is added to the heated aqueous medium. The material for forming the melamine resin is for example methylol melamine. Furthermore, the surface-treated magnetic powder is added thereto to give a liquid mixture. The thus obtained liquid mixture is sufficiently stirred. Preferably, the temperature of the liquid mixture is for example no less than 25° C. and no greater than 50° C. Furthermore, an aqueous medium is added to the liquid mixture, and the liquid mixture is heated to a specific temperature under stirring and maintained for several hours (for example, for no less than 1 hour and no greater than 5 hours). The specific temperature is for example no less than 60° C. and no greater than 80° C. After having been maintained at the specific temperature, the stirred liquid mixture is neutralized to have a pH of approximately 7. The neutralized liquid mixture is filtered to obtain a filter cake. The filter cake is washed and dried. As a result, the magnetic powder having a coating of the melamine resin is obtained.

<2. Toner Particle Preparation Process>

The toner particle preparation process is a process to prepare toner particles including the binder resin and the magnetic powder having a coating of the melamine resin. No particular limitations are placed on the toner particle preparation process and a known method is employed as appropriate so long as the particles of the magnetic powder having a coating of the melamine resin can be well dispersed in the binder resin. Examples of the known method include a melt-kneading method and an aggregation method. In the toner particle preparation process, an optional component (for example, a colorant, a charge control agent, or a releasing agent) may be dispersed in the toner particles.

The toner particle preparation process according to the melt-kneading method for example includes a mixing step and a kneading step. The mixing step involves mixing the binder resin, the magnetic powder having a coating of the melamine resin, and the optional component (for example, a colorant, a releasing agent, or a charge control agent) to give a mixture. The kneading step involves melt-kneading the mixture to give a kneaded product. The toner particle preparation process according to the melt-kneading method may further include a pulverizing step and a classifying step. The pulverizing step involves pulverizing the kneaded product obtained as described above. The classifying step involves classifying the pulverized kneaded product to give toner particles having a desired particle size. The melt-kneading method is preferable in terms of ease of production of the toner par ides or dispersibility of the colorant.

The toner particle preparation process according to the aggregation method for example includes an aggregation step and a coalescence step. The aggregation step involves causing fine particles including toner particle components to aggregate in an aqueous medium to form aggregated particles. The coalescence step involves causing the components included in the aggregated particles to coalesce in the aqueous medium to form toner particles. In a situation in which the toner particles are prepared using the aggregation method, it tends to be easier to obtain toner particles that are uniform in terms of shape and particle size.

The toner particle preparation process may further include a washing step and a drying step. The washing step involves washing the toner particles with an aqueous medium. The following describes two preferable washing methods. According to one of the washing methods, the toner particles are dispersed in an aqueous medium to give an aqueous dispersion containing the toner particles. Next, a wet cake of the toner particles is collected from the aqueous dispersion through solid-liquid separation. The collected wet cake is washed using an aqueous medium. According to the other of the washing methods, sedimentation of the toner particles is caused in an aqueous dispersion containing the toner particles. Next, a supernatant is substituted with an aqueous medium. Thereafter, the toner particles are re-dispersed in the aqueous medium.

The drying process involves drying the toner particles. One example of a preferable method for drying the toner particles involves using a dryer (more specifically, a spray dryer, a fluidized bed dryer, a vacuum freeze dryer, or a reduced pressure dryer). Of the dryers listed above, the spray dryer is preferable in terms that use of the spray dryer makes it easier to inhibit aggregation of the toner particles during drying. In a situation in which a spray dryer is used, an external additive such as silica can be caused to adhere to the surfaces of the toner particles by spraying a dispersion of the external additive together with the dispersion of the toner particles.

The toner according to the present embodiment has been described above. The toner according to the present embodiment is excellent in low-temperature fixability and charge stability. Therefore, the toner according to the present embodiment can be favorably used in various image forming apparatuses.

EXAMPLES

[Magnetic Powders A-B]

First, 28 L of a 4.5 N aqueous sodium hydroxide solution was added to 30 L of a 2 mol/L aqueous ferrous sulfate solution and heated at 90° C. to give a solution mixture adjusted to pH 10.5. Next, the solution mixture was subjected to aeration at 80 L of air per minute for 100 minutes while being maintained at a temperature of 90° C. to promote an oxidation reaction. As a result, a suspension was obtained. An aqueous sulfuric acid solution was added to the suspension to adjust the suspension to pH 7.0. Thereafter, the suspension was subjected to aeration at 80 L of air per minute for 10 minutes while being maintained at a temperature of 90° C. As a result, a solution containing magnetite particles was obtained.

The thus obtained solution containing magnetite particles was filtered to obtain a filter cake. The filter cake was washed with ion exchanged water. The filter cake was then dried and pulverized. As a result, magnetite particles were obtained. The magnetite particles (magnetic powder A) had the following properties.

Average particle size: 0.2 μm.

Shape: octahedral

Coercivity in a measurement magnetic field of 796 kA/m: 8.5 kA/m

Saturation magnetization: 82 $Am^2/kg$

Residual magnetization: 5.0 $Am^2/kg$

The coercivity, the saturation magnetization, and the residual magnetization of the magnetic powder A were measured using a vibrating sample magnetometer ("VSM-P7", product of TOEI INDUSTRY CO., LTD.) under a condition of an external magnetic field of 796 kA/m.

The magnetic powder A was dispersed in an aqueous medium to give a suspension. Next, the suspension was adjusted to pH 4. Next, a methoxy silane coupling agent ("Z-6030", product of Dow Corning Toray Co., Ltd.) in an amount of 2% by mass relative to the mass of the magnetic powder was added to the suspension to promote a coupling reaction. Thereafter, a solid content from the suspension was washed and dried. Through the above, the surface of the magnetic powder A was treated. Next, a three-necked flask was placed in a water bath at 30° C. Into the flask, 500 mL of ion exchanged water and hydrochloric acid were added to give an aqueous solution at pH 4. Next, 2 mL of methylol melamine ("MIRBANE (registered Japanese trademark) resin SM-607", product of Showa Denko K.K.) was added into the flask and dissolved in the aqueous solution. Next, 300 g of the surface-treated magnetic powder A was added into the flask and stirred sufficiently. Furthermore, 500 mL of ion exchanged water was added into the flask. The flask contents were heated under stirring and maintained at 70° C. for 2 hours. The flask contents were then neutralized to pH 7. The neutralized flask contents were filtered to obtain a filter cake. The filter cake was washed and dried. As a result, a magnetic powder B having a coating of a melamine resin was obtained. The SP value of the melamine resin was calculated to be 8.5.

[Non-Crystalline Polyester Resin A]

A four-necked flask was used as a reaction vessel. The four-necked flask was a 2 L reaction vessel equipped with a thermometer, a stainless steel stirrer, a glass nitrogen inlet tube, and a falling-type condenser. Into the reaction vessel, 45 mol % of ethylene glycol, 40 mol % of terephthalic acid, and 5 mold of 1,2,4-tribenzene carboxylic acid anhydride were added. The reaction vessel was placed on a heating mantle. Nitrogen gas was introduced through the glass nitrogen inlet tube to the reaction vessel to create an inert atmosphere within the reaction vessel. Next, the inner temperature of the reaction vessel was increased to 230° C. with the content (monomer mixture) of the reaction vessel under stirring. The content was kept under stirring at 230° C. to promote a polymerization reaction. During the polymerization reaction, a small amount of a resin in the reaction vessel was collected to measure an acid value thereof. The polymerization reaction was stopped once the acid value of the resin reached 10 mgKOH/g. The content of the reaction vessel was moved to a stainless tray and cooled to room temperature. As a result, a non-crystalline polyester resin A was obtained. The SP value of the non-crystalline polyester resin A was calculated to be 9.1.

[Preparation of Crystalline Polyester Resins A-C]

[Crystalline Polyester Resin A]

A four-necked flask was used as a reaction vessel. The four-necked flask was a 2 L reaction vessel equipped with a thermometer, a stainless steel stirrer, a glass nitrogen inlet tube, and a falling-type condenser. Into the reaction vessel, 630 g of 1,6-hexanediol, 700 g of fumaric acid, 60 g of ethylene glycol, and 175 g of trimellitic anhydride were added. The reaction vessel was placed on a heating mantle. Nitrogen gas was introduced through the glass nitrogen inlet tube to the reaction vessel to create an inert atmosphere within the reaction vessel. Next, the inner temperature of the reaction vessel was increased to 200° C. with the content (monomer mixture) of the reaction vessel under stirring. The content was kept under stirring at 200° C. to promote a polymerization reaction. The content of the reaction vessel was moved to a stainless tray and cooled to room temperature (25° C.). As a result, a crystalline polyester resin A was obtained. The SP value of the crystalline polyester resin A was 9.9.

[Crystalline Polyester Resin B]

A crystalline polyester resin B was obtained in the same manner as for the crystalline polyester resin A except that 1,4-butanediol was used instead of 1,6-hexanediol and stearic acid was used instead of fumaric acid. The SP value of the crystalline polyester resin B was 9.5.

[Crystalline Polyester Resin C]

A crystalline polyester resin C was obtained in the same manner as for the crystalline polyester resin A except that 1,4-butanediol was used instead of 1,6-hexanediol. The SP value of the crystalline polyester resin C was 9.4.

[Production of Toner]

Example 1

The following materials were mixed for 4 minutes at a rotation speed of 2,000 rpm using an FM mixer ("FM-20", product of Nippon Coke & Engineering Co., Ltd.).

Non-crystalline polyester resin A: 45% by mass

Charge control agent ("FAC-207P", product of FUJIKURA KASEI CO., LTD.): 3% by mass Magnetic powder B: 44% by mass Releasing agent ("WEP-7", product of NOF Corporation): 3% by mass Crystalline polyester resin A: 5% by mass The resulting mixture was melt-kneaded using a twin screw extruder ("PCM-30", product of Ikegai Corp.) under conditions of a melt-kneading temperature (cylinder temperature) of 120° C., a rotation speed of 150 rpm, and a process speed of 100 g/minute. The resulting melt-kneaded product was coarsely pulverized into a size of approximately 2 mm using a pulverizer ("Rotoplex (registered Japanese trademark)", product of Hosokawa Micron Corporation) and pulverized using a mechanical pulverizer ("Turbo Mill T250", product of Freund-Turbo Corporation). The resulting pulverized product was classified using an air classifier ("model EJ-L3", product of Nittetsu Mining Co., Ltd.). Through the above, toner mother particles having an average particle size of 8 μm were obtained.

Next, 100 parts by mass of the toner mother particles, 0.8 parts by mass of silica fine particles ("RA200", product of Nippon Aerosil Co., Ltd.), and 0.8 parts by mass of titanium oxide ("EC100", product of Titan Kogyo, Ltd.) were mixed for 5 minutes at a rotation speed of 2,000 rpm using an FM mixer ("FM-20", product of Nippon Coke & Engineering Co., Ltd.) to give a toner 1.

Example 2

A toner 2 was obtained in the same manner as for the toner 1 of Example 1 except that the crystalline polyester resin B was used instead of the crystalline polyester resin A.

Example 3

A toner 3 was obtained in the same manner as for the toner 1 of Example 1 except that the crystalline polyester resin C was used instead of the crystalline polyester resin A.

Comparative Example 1

A toner R1 was obtained in the same manner as for the toner 1 of Example 1 except that the crystalline polyester resin A was not used.

Comparative Example 2

A toner R2 was obtained in the same manner as for the toner 1 of Example 1 except that the magnetic powder A was used instead of the magnetic powder B.

Comparative Example 3

A toner R3 was obtained in the same manner as for the toner 1 of Example 1 except that the crystalline polyester resin A was not used and the magnetic powder A was used instead of the magnetic powder B.

[Evaluation Methods]

The toners obtained in Examples 1 to 3 and Comparative Examples 1 to 3 were evaluated as described below.

(1) Fixability of Toner

A modified printer (modified version of "FS-1370DN", product of KYOCERA Document Solutions Inc.) was used as an evaluation apparatus. The evaluation apparatus is a printer modified to enable temperature adjustment by taking a fixing unit out of the printer. With respect to each of the toners obtained in Examples and Comparative Examples, the toner was set in the evaluation apparatus. The method by which low-temperature fixability is evaluated includes five steps (an image formation step, an image stressing process, a peeling observation step, a determination step, and an evaluation step). In the image formation step, 1.5 mg/cm$^2$ of the toner was transferred onto a recording medium (paper CC90) and fixed thereto at 150° C. As a result, a solid image (image density: 100%) was obtained. In the image stressing step, the recording medium was folded such that a surface thereof on which the solid image was formed faced inward and the solid image was folded in half. A 1 kg brass weight was rubbed back and forth on the fold of the recording medium five times. In the peeling observation step, the recording medium was unfolded and the degree of peeling of the toner on the fold was observed. In the determination step, toner peeling having a length of no less than 1 mm was determined to be "bad" and toner peeling having a length of less than 1 mm was determined to be "good". In a situation in which the toner peeling was determined to be "bad", the above-described four steps were performed on the toner as described above except that the fixing temperature was increased by 5° C. The four steps were repeated until toner peeling was determined to be "good". A lowest of the fixing temperatures at which toner peeling was determined to be "good" was taken to be a minimum fixing temperature. In the evaluation step, fixability of the toner was evaluated based on the thus obtained minimum fixable temperature in accordance with the following standard.

A (good): A minimum fixable temperature of no greater than 180° C.

B (bad): A minimum fixable temperature of greater than 180° C.

(2) Image Density (Charge Stability of Toner)

With respect to each of the toners, the toner was set in a developing device in a printer (modified version of "AS-1370DN", product of KYOCERA Document Solutions Inc.) and left to stand in a standard temperature and humidity environment (temperature: 23° C., relative humidity: 50%) for 24 hours. Thereafter, an evaluation image was output in the standard temperature and humidity environment. The evaluation image was a solid image (image density: 100%) including a plurality of square shapes (2.5 cm×2.5 cm) arranged in a pattern. The reflection density of a central portion of the evaluation image was measured using a reflectance densitometer ("SpectroEye (registered Japanese trademark)", product of Gretag Macbeth). Likewise, the toner was set in the developing device and left to stand in a high temperature and humidity environment (temperature: 50° C., relative humidity: 80%) for 24 hours. Thereafter, the evaluation image was output in the high temperature and humidity environment to measure an image density thereof. Using the thus obtained image densities, charge stability of the toner in the standard temperature and humidity environment, and charge stability of the toner in the high temperature and humidity environment were evaluated in accordance with the following standard.

A (good): An image density of no less than 1.0

B (bad): An image density of less than 1.0

Table 1 shows a list of the toners prepared and evaluation results of the toners.

TABLE 1

| | | Magnetic powder | | | Fixability of toner | | Image density | | | |
|---|---|---|---|---|---|---|---|---|---|---|
| | | | | | | | Standard temperature and humidity environment (23° C./50% RH) | | High temperature and humidity environment (30° C./80% RH) | |
| | Toner | Type | Coating of melamine resin | SP value of crystalline polyester resin | Fixing temperature/° C. | Evaluation | | Evaluation | | Evaluation |
| Example 1 | 1 | A | Present | 9.9 | 180 | A | 1.28 | A | 1.16 | A |
| Example 2 | 2 | A | Present | 9.5 | 180 | A | 1.25 | A | 1.11 | A |
| Example 3 | 3 | A | Present | 9.4 | 180 | A | 1.18 | A | 1.03 | A |
| Comparative Example 1 | R1 | A | Present | — | 200 | B | 1.32 | A | 1.22 | A |
| Comparative Example 2 | R2 | B | Absent | 9.9 | 180 | A | 0.84 | B | 0.63 | B |
| Comparative Example 3 | R3 | B | Absent | — | 200 | B | 1.03 | A | 0.88 | B |

The toners 1 to 3 of Examples 1 to 3 had an evaluation of A (good) in the fixability evaluation. The toners R1 and R3 of Comparative Examples 1 and 3 had an evaluation of B (bad) in the fixability evaluation. The results indicate that the toners 1 to 3 of Examples 1 to 3 are superior in fixability to the toners R1 and R3 of Comparative Examples 1 and 3.

The toners 1 to 3 of Examples 1 to 3 had an evaluation A (good) in both the charge stability evaluation in the standard temperature and humidity environment and the charge stability evaluation in the high temperature and humidity environment. The toners R2 and R3 of Comparative Examples 2 and 3 had at least one evaluation of B (bad) in the charge stability evaluations. The results indicate that the toners 1 to 3 of Examples 1 to 3 are superior in charge stability to the toners R2 and R3 of Comparative Examples 2 and 3.

The toners 1 to 3 of Examples 1 to 3 had an evaluation of A (good) in all the fixability evaluation and the charge stability evaluations. The toners R1 to R3 of Comparative Examples 1 to 3 had at least one evaluation of B (bad) in the fixability evaluation and the charge stability evaluations. The results indicate that the toners 1 to 3 of Examples 1 to 3 are superior in low-temperature fixability and charge stability to the toners R1 to R3 of Comparative Examples 1 to 3.

INDUSTRIAL APPLICABILITY

The toner according to the present disclosure is usable for forming images in for example a copier or a printer.

What is claimed is:

1. A magnetic toner comprising toner particles, wherein the toner particles contain a binder resin and a magnetic powder, the binder resin includes a crystalline polyester resin, the magnetic powder has a coating of a melamine resin, the crystalline polyester resin has a solubility parameter ($SP_C$) of no less than 9.5, and the solubility parameter ($SP_C$) of the crystalline polyester resin and a solubility parameter ($SP_M$) of the melamine resin satisfy formula (1) shown below:

$$SP_C - SP_M > 1.0 \quad (1).$$

2. The magnetic toner according to claim 1, wherein the binder resin includes an additional resin in combination with the crystalline polyester resin, and the $SP_C$, the $SP_M$, and a solubility parameter ($SP_T$) of the additional resin satisfy formula (2) shown below:

$$SP_C > SP_T > SP_M \quad (2).$$

3. The magnetic toner according to claim 2, wherein the additional resin is a non-crystalline polyester resin.

* * * * *